US007683701B2

(12) United States Patent
Georgescu et al.

(10) Patent No.: US 7,683,701 B2
(45) Date of Patent: Mar. 23, 2010

(54) LOW POWER BANDGAP REFERENCE CIRCUIT WITH INCREASED ACCURACY AND REDUCED AREA CONSUMPTION

(75) Inventors: Bogdan I. Georgescu, Colorado Springs, CO (US); Iulian C. Gradinariu, Colorado Springs, CO (US)

(73) Assignee: Cypress Semiconductor Corporation, San Jose, CA (US)

( * ) Notice: Subject to any disclaimer, the term of this patent is extended or adjusted under 35 U.S.C. 154(b) by 49 days.

(21) Appl. No.: 11/321,854

(22) Filed: Dec. 29, 2005

(65) Prior Publication Data

US 2007/0152740 A1 Jul. 5, 2007

(51) Int. Cl.
*G05F 3/16* (2006.01)

(52) U.S. Cl. ..... 327/539; 323/316

(58) Field of Classification Search ..... 327/530, 327/538, 539, 313–316, 540–543; 323/313–316
See application file for complete search history.

(56) References Cited

U.S. PATENT DOCUMENTS 4,947,135 A * 8/1990 Mijuskovic ..... 330/9
5,867,012 A 2/1999 Tuthill
6,014,020 A * 1/2000 Kuttner ..... 323/317
6,016,051 A 1/2000 Can ..... 323/315
6,052,020 A 4/2000 Doyle ..... 326/316
6,075,407 A * 6/2000 Doyle ..... 327/539
6,166,670 A * 12/2000 O'Shaughnessy ..... 341/136
6,215,353 B1 * 4/2001 Lewyn ..... 327/538
6,242,974 B1 * 6/2001 Kunst ..... 330/9
6,384,586 B1 * 5/2002 Sugawara ..... 323/313
6,462,612 B1 * 10/2002 Roh et al. ..... 327/539
6,509,854 B1 * 1/2003 Morita et al. ..... 341/144
6,531,857 B2 3/2003 Ju ..... 327/539
6,535,054 B1 * 3/2003 Ceekala et al. ..... 327/539
6,587,000 B2 * 7/2003 Oikawa ..... 330/288
6,677,808 B1 * 1/2004 Sean et al. ..... 327/539
6,788,131 B1 * 9/2004 Huang ..... 327/539
6,833,751 B1 * 12/2004 Atrash ..... 327/534
6,946,825 B2 * 9/2005 Tesi ..... 323/313
6,954,059 B1 * 10/2005 MacLean ..... 323/316

(Continued)

FOREIGN PATENT DOCUMENTS

WO 2004/077192 9/2004

OTHER PUBLICATIONS

Abstact Plus (http://ieeexplore.ieee.org/xpl/absprintf.jsp?arnumber=1359090), IEEE Xplore, IEEE, 2006.*

(Continued)

*Primary Examiner*—Lincoln Donovan
*Assistant Examiner*—Thomas J Hiltunen

(57) ABSTRACT

Bandgap reference (BGR) circuits and methods are described herein for providing high accuracy, low power Bandgap operation when using small, low voltage devices in the analog blocks of the BGR circuit. In some cases, chopped input stabilization and dynamic current matching techniques may be combined to compensate for input voltage offsets in the operational amplifier portion and current offsets in the current mirror portion of the Bandgap circuit. When used together, the chopped stabilization and dynamic current matching techniques provide a significant increase in accuracy, especially when using small, low voltage devices in the analog blocks to reduce layout area and support low power supply operation (e.g., power supply values down to about 1.4 volts and below).

15 Claims, 6 Drawing Sheets

U.S. PATENT DOCUMENTS

| | | | | |
|---|---|---|---|---|
| 6,957,278 | B1 * | 10/2005 | Gallagher et al. | 710/1 |
| 7,176,750 | B2 * | 2/2007 | Oddone et al. | 327/539 |
| 7,236,048 | B1 * | 6/2007 | Holloway et al. | 327/539 |
| 2005/0231270 | A1 | 10/2005 | Washburn | |
| 2006/0284668 | A1 * | 12/2006 | Chou | 327/539 |
| 2007/0252573 | A1 * | 11/2007 | Tachibana et al. | 323/313 |

OTHER PUBLICATIONS

Lian-Xi et al., "A High Accuracy Bandgap Reference with Chopped Modulator to Compensate MOSFET Mismatch," © 2005 IEEE, 4 pages.

Atrash et al., "A Bandgap Reference Circuit Utilizing Switching to Reduce Offsets and a Novel Technique for Leakage Current Compensation," Poster Session IV: Analog & Mixed Signal Design, © 2004 IEEE, pp. 297-300.

International Search Report, PCT/US2006/061992, mailed Sep. 12, 2007.

International Written Opinion of International Searching Authority, dated Jun. 29, 2008 for International Application No. PCT/US2006/061992.

Ceekala et al. "A Method for Reducing the Effects of Random Mismatches in CMOS Bandgap References," ISSCC 2002/Session 23/Analog Techniques/ 23.7; 2002 IEEE International Solid-State Circuits Conference; 2 pages.

EP Application #06 849 212.3; Examination Report, dated Mar. 30, 2009; 5 pages.

* cited by examiner

| Clock Period | Group A active switch | Group B active switch | Group C active switch |
|---|---|---|---|
| 1 | A1 | B2 | C3 |
| 2 | A1 | B3 | C2 |
| 3 | A2 | B3 | C1 |
| 4 | A3 | B2 | C1 |
| 5 | A3 | B1 | C2 |
| 6 | A2 | B1 | C3 |

FIG. 9

| Parameter | Old Design | New design | Improvement |
|---|---|---|---|
| PVT accuracy (%) | 1.82 | 1.74 | Yes (5%) |
| MC accuracy (%) | 1.78 | 0.68 | Yes (160%) |
| Total accuracy (%) | 2.55 | 1.87 | Yes (35%) |
| TC ( ppm /C) | 66 | 48 | Yes (35%) |
| ICC (μA) | 80 | 160 | No ( - 100%) |
| Startup time (μs) | 57 | 10 | Yes (470%) |
| Settling time (μs) | 78 | 20 | Yes (290%) |
| Overshoot (%) | 3.7 | 0 | Yes(1000%) |
| LF PSR (dB) | 25 | 32 | Yes(7dB) |
| HF PSR (dB) | 55 | 74 | Yes(19dB) |
| Area (Kμm2) | 111 | 22 | Yes(500%) |

FIG. 10

LOW POWER BANDGAP REFERENCE CIRCUIT WITH INCREASED ACCURACY AND REDUCED AREA CONSUMPTION

BACKGROUND OF THE INVENTION

1. Field of the Invention

This invention relates to electronic circuits and, more particularly, to low power supply Bandgap Reference (BGR) circuits used to generate reference currents and reference voltages on a semiconductor device with high accuracy using small gate area, low voltage devices in the analog blocks.

2. Description of the Related Art

The following descriptions and examples are given as background only.

Virtually all systems that manipulate analog, digital or mixed signals, such as analog-to-digital and digital-to-analog converters, rely on at least one reference voltage as a starting point for all other operations in the system. Not only must a reference voltage be reproducible every time the circuit is powered up, the reference voltage must remain relatively unchanged with variations in fabrication process, operating temperature and supply voltage.

A Bandgap reference (BGR) circuit is one manner in which a relatively stable reference voltage may be generated. As explained in more detail below, BGR circuits rely on the predictable variation with temperature of the bandgap energy of the underlying semiconductor material. There are generally two types of BGR circuits, referred to herein as "voltage adding" and "current adding" BGR configurations.

FIG. 1 illustrates an exemplary block diagram of a voltage adding Bandgap reference circuit 100. In general, BGR circuit 100 is configured for producing a reference voltage ($V_{REF}$) as a weighted sum of two voltages: $V_1$, which is proportional to absolute temperature (PTAT), and $V_2$, which is complementary to absolute temperature (CTAT). As shown in FIG. 1, the reference voltage may be expressed as:

$$V_{REF}=\alpha 1*V_1+\alpha 2*V_2 \quad (1)$$

where $V_1$ has a positive temperature coefficient ($TC_{POSV}$), $V_2$ has a negative temperature coefficient ($TC_{NEGV}$) and $\alpha$1, $\alpha$2 are non-dimensional coefficients chosen to minimize temperature-dependent variations in the reference voltage across a specified range of temperatures.

Voltage adding BGR circuit 100 may be used for generating a reference voltage, which exhibits relatively little variation across a defined range of temperatures, process corners and supply voltages. As shown in FIG. 2, for example, circuit 100 may provide a relatively constant reference voltage ($V_{REF}$) across a defined range of temperatures ($T_{-x}$, $T_{+x}$), if the coefficients $\alpha$1, $\alpha$2 are chosen such that there is a temperature, $T_0$, for which:

$$d(V_{REF})/dT=\alpha 1*TC_{POSV}+\alpha 2*TC_{NEGV}=0 \text{ at } T=T_0 \quad (2)$$

where T is the absolute temperature (K) and $T_{-x}<T_0<T_{+x}$. In other words, ($T_{-x}$, $T_{+x}$) defines the range of temperatures for which voltage adding BGR circuit 100 is intended to operate.

In some cases, the negative temperature coefficient voltage ($V_2$) may be generated by developing a voltage across a forward-biased P-N junction diode. In other cases, $V_2$ may be generated by diode-connecting a bipolar junction transistor (BJT), such that the base-emitter voltage ($V_{BE}$) drop is the voltage that exhibits bandgap behavior. As used herein, the term "diode" may refer to any diode-like element (including diodes, BJTs and CMOS transistors operating in the subthreshold region), which exhibits a diode voltage drop.

In some cases, the positive temperature coefficient voltage ($V_1$) may be generated by subtracting the voltages developed across two P-N junction diodes or two bipolar junction transistors (BJTs). For example, the PTAT voltage can be generated as: 1) the difference between the forward voltages of two P-N junction diodes operating at different current densities, or 2) the difference between the base-emitter voltages ($V_{BE}$) of two bipolar junction transistors (BJTs) biased in normal active mode of operation, with the two respective base-emitter junctions having different current densities.

In one example, the two forward biased P-N junction diodes (or two BJTs) may be configured to operate at different current densities by constructing the diodes, such that a ratio between the areas of the diodes is N. The ratio (N) between the areas of the two diodes (D1, D2) is usually implemented by replicating the first diode (D1) a number of times (N) to generate the second diode (D2) with N times larger area.

Voltage adding BGR circuit 100 represents an effective technique for obtaining a reference voltage of about 1.25 volts given a supply voltage of a few volts (e.g., about 3 to 5 volts). However, the functionality of circuit 100 tends to suffer (and sometimes fail) under low power supply conditions (e.g., power supply voltages of about 1.6 volts and below, depending on technology). In addition, circuit 100 provides only one reference voltage output (around 1.25 volts), and therefore, cannot be used when more than one reference voltage, a different reference voltage, or a reference current is desired.

Therefore, current adding BGR circuits are sometimes used in place of voltage adding BGR circuits to overcome the disadvantages associated therewith. For example, current adding BGR circuits are often preferred over voltage adding BGR circuits for their ability to: (a) operate under low power supply conditions (e.g., 1.6 volts and below), (b) provide multiple reference voltage outputs simultaneously (including those other than 1.25 volts), and (c) generate both reference voltage and reference current outputs at the same time.

FIG. 3 illustrates one manner in which a stable reference voltage ($V_{REF}$) may be generated by creating a reference current and then passing it through a resistor. For example, current adding BGR circuit 300 may be used to generate a reference current ($I_{OUT}$) as a weighted sum of two currents: $I_1$, having a positive temperature coefficient ($TC_{POSI}$), and $I_2$, having a negative temperature coefficient ($TC_{NEG1}$). The reference current ($I_{OUT}$) may be expressed as:

$$I_{OUT}=\beta_1*I_1+\beta_2*I_2 \quad (3)$$

where $I_1$ is the PTAT current, $I_2$ is the CTAT current, and $\beta_1$ and $\beta_2$ are non-dimensional coefficient values chosen to minimize temperature-dependent variations in the reference current across the specified range of temperatures.

As shown in FIG. 3, a reference voltage ($V_{REF}$) may be generated by passing the reference current ($I_{OUT}$) generated by circuit 300 through a resistor of value R such that:

$$V_{REF}=R*I_{OUT} \quad (4)$$

As in the previous circuit, the reference voltage $V_{REF}$ may demonstrate a relatively small variation (i.e., a small $\Delta V_{REF}$, as shown in FIG. 2) over a specified range of temperatures ($T_{-x}$, $T_{+x}$), if temperature-dependent variations in $I_{OUT}$ are minimized. For example, the temperature coefficient of resistor R is one factor, which plays an important role in defining the variation of $V_{REF}$ with temperature. Additional factors will be discussed in more detail below. In some cases, a small variation of $V_{REF}$ with temperature may be obtained by selecting appropriate values for the coefficients $\beta_1$ and $\beta_2$ in equation (3), so that the derivative of the reference voltage ($V_{REF}$) will be:

$$d(V_{REF})/dT=0 \text{ at } T=T_0 \quad (5)$$

where T is the absolute temperature (K) and $T_{-x}<T_0<T_{+x}$. As before, ($T_{-x}$, $T_{+x}$) defines the range of temperatures for which current adding BGR circuit 300 is intended to operate.

Unfortunately, current adding BGR circuits are notorious for their sensitivity to process-induced mismatch between circuit elements, which are otherwise intended to be identical (i.e., matched). For example, process-induced mismatch may occur during fabrication of a semiconductor device, causing otherwise identical devices (e.g., two PMOS transistors with identical gate areas, dopant concentrations, etc.) to exhibit substantially different threshold voltages and drain currents. Process-induced mismatch adversely affects Bandgap operation by shifting the reference voltage output and/or the temperature coefficient of $V_{REF}$.

In order to compensate for process-induced mismatch, some circuit designers have opted to use large, high voltage devices (with thick gate oxides and large gate areas) in the analog blocks of a Bandgap circuit to reduce gate leakage. Although the thick oxide (e.g., $t_{ox}\approx 60$ Å) of high voltage devices allows for virtually zero gate leakage, the use of high voltage devices produces a relatively large layout area, considerably increases the design effort and severely limits the overdrive of the matched transistors (especially when coupled with power supply specifications of about 2.0 volts and below). The exclusive use of high voltage devices also renders the approach unsuitable for low power supply voltages (e.g., 1.6 volts and below).

In order to meet low power supply specifications, other circuit designers have opted to combine large, low voltage devices with the use of dummy structures to compensate for process-induced mismatch. However, the thin gate oxides (e.g., $t_{ox}\approx 16$ Å) and large gate areas (e.g., about 100 to 500 $\mu m^2$) of the low voltage devices tend to significantly increase the gate leakage problem. In some cases, the amount of gate leakage attributable to the low voltage devices is comparable to the drain operating point current—a level which cannot be accurately controlled or compensated using dummy structures. In addition to uncontrollable gate leakage, the use of large, low voltage devices and dummy structures also results in a relatively large layout area.

Therefore, a need remains for a current adding BGR configuration capable of high accuracy, low power operation. In a preferred embodiment, high accuracy and low power specifications could be met by avoiding the use of large gate area devices within the analog blocks of the BGR circuit.

SUMMARY OF THE INVENTION

The following description of various embodiments of Bandgap reference circuits and methods is not to be construed in any way as limiting the subject matter of the appended claims.

According to one embodiment, a Bandgap reference (BGR) circuit is provided herein for generating a stable reference voltage across a specified range of process, voltage and temperature values. In one example, the BGR circuit may include a plurality of diodes coupled for producing a proportional to absolute temperature (PTAT) current and a complementary to absolute temperature (CTAT) current. The BGR circuit may also include an operational amplifier coupled for receiving a pair of voltages generated by the PTAT and CTAT currents and configured for generating a difference signal therefrom, and a three-branch current mirror circuit coupled for receiving the difference signal and configured for generating three substantially identical currents therefrom. In some cases, the BGR circuit may further include at least one resistor, which is coupled to an output of the three-branch current mirror circuit for receiving one of the substantially identical currents and for developing the stable reference voltage thereacross. In such cases, the BGR circuit may be described as having a "current adding" configuration.

According to a preferred embodiment, the BGR circuit described herein may be configured for reducing any voltage and current offsets that may occur within the BGR circuit as a result of process-induced transistor mismatch. For example, the operational amplifier and current mirror circuits described herein may be implemented primarily with small, low voltage devices to reduce layout area and enable low power operation. Circuits including such devices are often adversely affected by variations in device characteristics caused, e.g., when variations in process, voltage and/or temperature lead to transistor mismatch. In some cases, such variations may create large voltage and current offsets within the operational amplifier and current mirror portions of the Bandgap circuit, thereby reducing the accuracy thereof.

To improve accuracy, the operational amplifier ("op amp") may include a pair of chopped stabilization input circuits for reducing a voltage offset attributed to the small, low voltage devices used within the op amp circuit. In addition, the three-branch current mirror circuit may include a plurality of dynamically controlled switches for reducing a current offset attributed to the small low voltage devices used within the current mirror circuit. In one embodiment, the plurality of dynamically controlled switches may include three sets of three parallel-coupled switches, where each set of switches is coupled for receiving a different one of the three substantially identical currents.

Furthermore, a digital control block may be included within the BGR circuit for controlling the op amp and current mirror portions. For example, the digital control block may be configured for reducing current offsets by dynamically matching the outputs of the current mirror circuit. In some cases, the digital control block may also be configured for reducing voltage offsets by modulating an output of the operational amplifier. As described in more detail below, the digital control block may be coupled for receiving a first clocking signal from an internal clock source and for generating a plurality of the control signals in response thereto.

In some cases, a first subset of control signals may be supplied to the operational amplifier for reducing mismatch-induced voltage offsets by modulating the difference signal (i.e., the output of the operational amplifier) with a second clocking signal, whose duty cycle is about 50% that of the first clocking signal. In other words, the digital control block may generate the first subset of control signals by dividing the first clocking signal in half to generate two equal-length phases of the second clocking signal. The first subset of control signals may then be supplied to the pair of chopped stabilization input circuits for reducing any mismatch-induced voltage offsets that may (or may not) occur within the operational amplifier. For example, the first subset of control signals may be used for generating a positive voltage offset during a first clock phase and an equally negative voltage offset during a next clock phase, where a "clock phase" is defined herein as one-half of a clock period. In this manner, any voltage offsets occurring within the operational amplifier may be reduced and/or eliminated by averaging the equally positive and negative voltage offset portions generated over two consecutive phases of the second clocking signal.

In some cases, the digital control block may use one of the first subset of control signals to generate a second subset of control signals, corresponding to six distinct phases of a third clocking signal. In other words, the digital control block may generate the second subset of control signals by dividing one phase of the second clocking signal by six, thereby generating six equal-length phases of the third clocking signal. The second subset of the control signals may then be supplied to the current mirror circuit for reducing any mismatch-induced current offsets that may (or may not) occur within the current mirror circuit. For example, the second subset of control signals may be used for controlling the plurality of switches, such that only one switch within each set of switches is activated for conducting current during each of the six clock phases. In this manner, any current offsets occurring within the current mirror circuit may be reduced and/or eliminated by controlling the activation of switches, so that the three substantially identical currents are averaged over the six consecutive phases of the third clocking signal.

According to another embodiment, a method is provided herein for reducing mismatch-induced voltage and current offsets within a current adding Bandgap reference (BGR) circuit comprising a three-branch current mirror circuit and operational amplifier, as described above. For example, the method may include modulating an output of the operational amplifier with a 50% duty cycle clocking signal to reduce any voltage offsets attributed to the operational amplifier. In some cases, the method may also include: i) supplying the modulated output of the operational amplifier to the three-branch current mirror circuit for generating three substantially identical currents in response thereto, and ii) generating a plurality of digital control signals, each representing a different phase of the clocking signal. In a preferred aspect of the invention, the plurality of digital control signals may be used to reduce any current offsets that may (or may not) occur within the current mirror circuit by averaging the three substantially identical currents over all phases of the clocking signal.

BRIEF DESCRIPTION OF THE DRAWINGS

Other objects and advantages of the invention will become apparent upon reading the following detailed description and upon reference to the accompanying drawings in which:

FIG. 9 is a table illustrating an exemplary switching scheme that may be applied to the plurality of switches included within the current mirror circuit of FIG. 8; and FIG. 10 is a table comparing exemplary simulation results for the Bandgap circuit shown in FIGS. 4-9 (i.e., the "new design") and a simple current adding configuration that does not use dynamic current matching or input chopper stabilization (i.e., the "old design").

Figure 1:
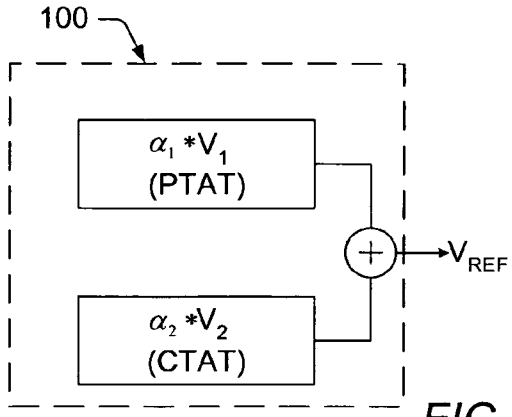
FIG. 1 (Related Art)
FIG. 1 is a block diagram of a voltage adding Bandgap circuit.
Figure 2:
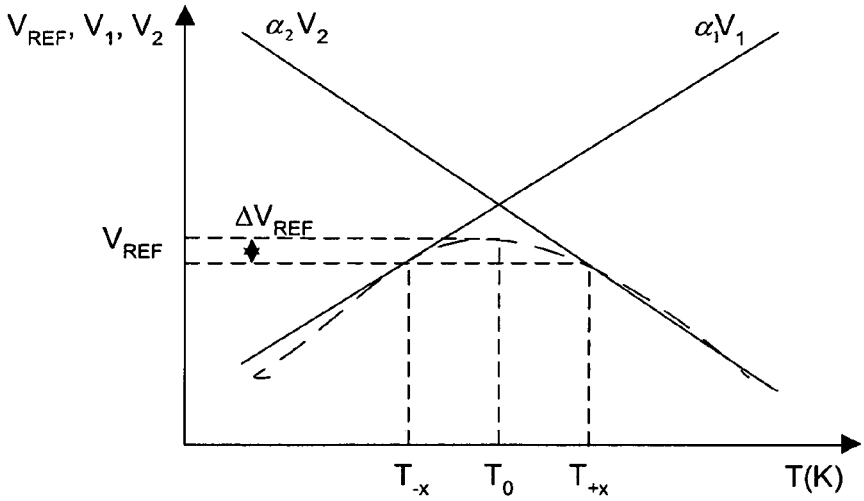
FIG. 2 (Related Art)
FIG. 2 is a graph illustrating the temperature dependency of the reference voltage ($V_{REF}$) and its voltage components for the voltage adding Bandgap circuit of FIG. 1.
Figure 3:
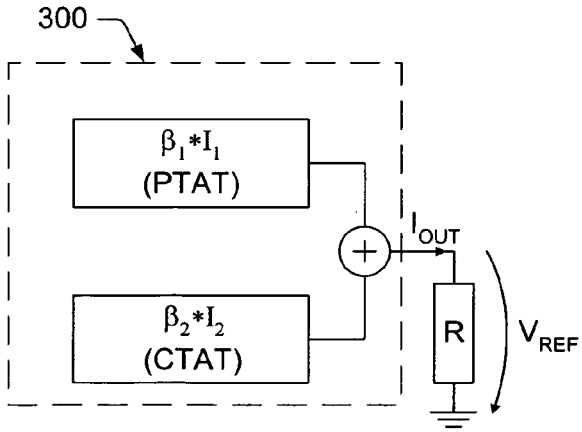
FIG. 3 (Related Art
FIG. 3 is a block diagram of a current adding Bandgap circuit followed by a current-to-voltage conversion circuit.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF PREFERRED EMBODIMENTS

Bandgap reference (BGR) circuits are used for generating reference voltages, which exhibit relatively little variation across a defined range of temperatures, process corners and supply voltages. The two types of BGR circuits include voltage adding and current adding configurations. Although voltage adding BGR circuits are often successfully used for generating a single reference voltage output (e.g., about 1.25 volts) when supplied with a few volts (e.g., about 3 to 5 volts), they are generally unsuitable for low power operation (e.g., power supply voltages of about 1.6 volts and below) and applications, which prefer and/or require a different voltage output (e.g., other than 1.25 volts), multiple voltage outputs or a combination of voltage and current outputs.

For this reason, current adding BGR circuits are sometimes used to overcome the disadvantages of their voltage adding counterparts. However, in order to compensate for process-induced mismatch, most current adding BGR circuits utilize either large, high voltage devices or a combination of large, low voltage devices and dummy structures in the analog blocks of the BGR circuit. Although these solutions attempt to minimize mismatch, they are typically unsuitable for low power operation (e.g., when using high voltage devices), or are unable to accurately control gate leakage (e.g., when using low voltage devices and dummy structures).

Therefore, a better solution may be to use small, low voltage devices with thin gate oxides (e.g., $t_{ox}\approx$10-20 Å) and small gate areas (e.g., about 1 to 5 $\mu m^2$) within the analog blocks of the BGR circuit. Although this approach renders gate leakage negligible (e.g., less than 1% when compared to the drain operating point current), a problem arises in that small area devices tend to create huge mismatch-induced variations in both voltage and current offsets—a condition that ultimately reduces the accuracy of the Bandgap circuit. The inventive concepts described herein address this concern, while overcoming the disadvantages of the conventional solutions discussed above.

FIGS. 4-10 illustrate an exemplary current adding BGR configuration and method for providing high accuracy, low power Bandgap operation using small, low voltage devices in the analog blocks of the BGR circuit. As will be described in more detail below, the present invention combines chopped input stabilization and dynamic current matching techniques to compensate for input voltage offsets in the operational amplifier portion and current offsets in the current mirror portion of the Bandgap circuit. When used together, the chopped input stabilization and dynamic current matching techniques provide a significant increase in accuracy (e.g., about 35% improvement over older designs), while using small, low voltage devices in the analog blocks to reduce layout area (e.g., about 500% improvement over older designs) and enabling low power supply operation (e.g., from about 3.6V down to about 1.4 volts with the current technology, or down to about 1.0 volts with a slightly different technology).

Figure 4:
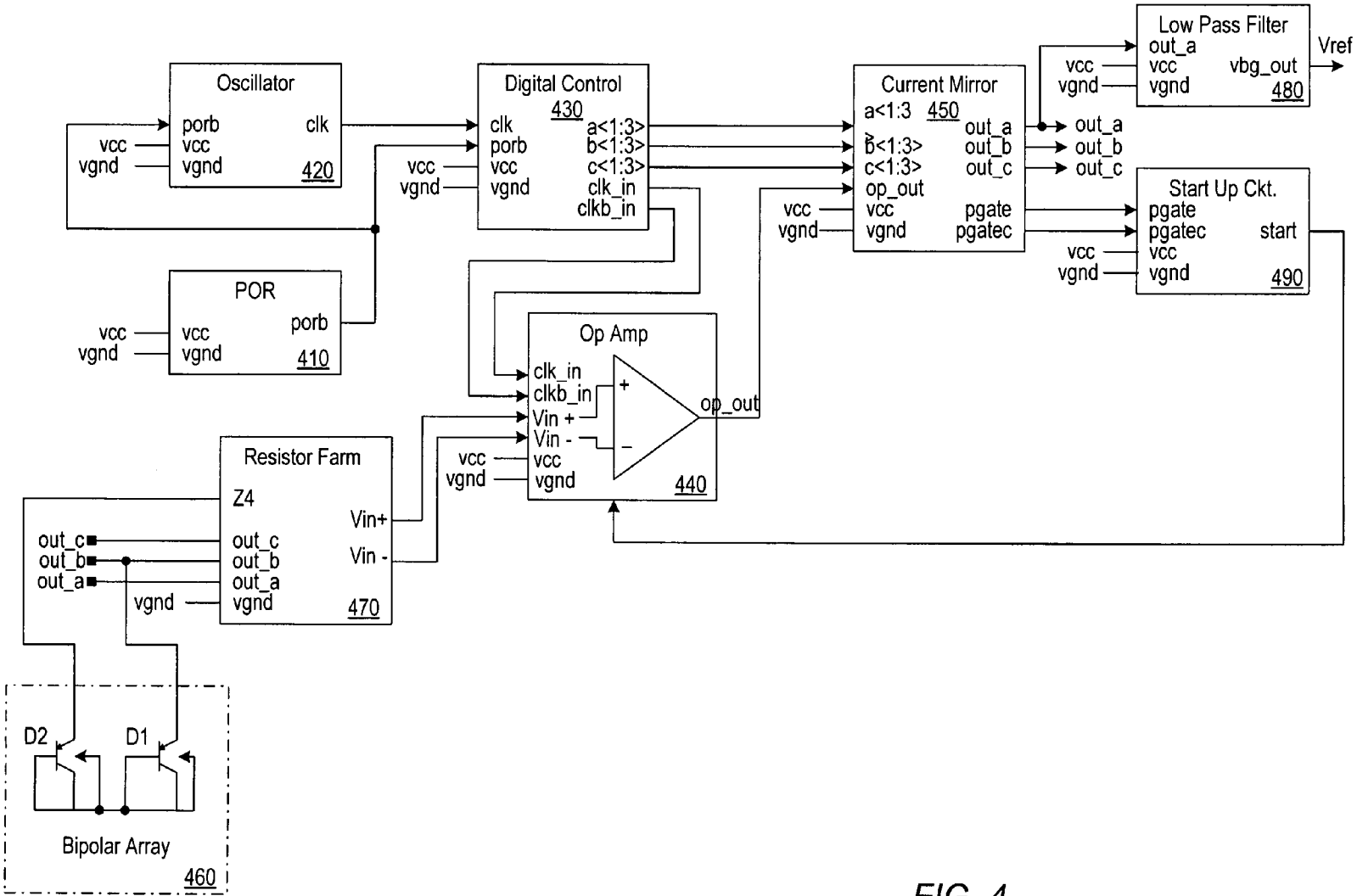
FIG. 4 is a block diagram illustrating one embodiment of a current adding Bandgap circuit in accordance with the present invention.

FIG. 4 illustrates one embodiment of an improved current adding BGR circuit 400 in accordance with the present invention. More specifically, FIG. 4 provides a block-level diagram illustrating the various analog and digital blocks that may be combined to form current adding BGR circuit 400. In the embodiment shown, the digital part of the BGR circuit consists of a Power On Reset (POR) block 410, a free-running oscillator 420 (optional) and a digital control block 430. The purpose of POR circuit 410 is to reset the digital control block and to ensure that the oscillator is running at power-up. The POR circuit performs these functions by supplying a power-on reset signal (e.g., an active low "porb" signal) to oscillator 420 and digital control block 430 once the power supply voltage (VCC) reaches a predetermined level (e.g., a minimum operating voltage level). Substantially any POR circuit known in the art may be used to generate the power-on reset signal.

In some cases, oscillator 420 may be included in various circuits and systems, which do not already include an internal clock. If included, oscillator 420 may be used for generating an internal clocking signal ("clk") upon system power-up (e.g., upon receiving the "porb" signal from POR circuit 410). More specifically, oscillator 420 may be configured for generating the internal clocking signal at some target frequency. An acceptable target frequency may be about 10 MHz; however, it is noted that other target frequencies may be generated, depending on application. For example, internal clocking signals with target frequencies ranging between about 7 MHz to about 13 MHz may be generated over a specified range of process, voltage and temperature (PVT) corners. In some cases, oscillator 420 may consume less than 50 μA of operating current.

Figure 5:
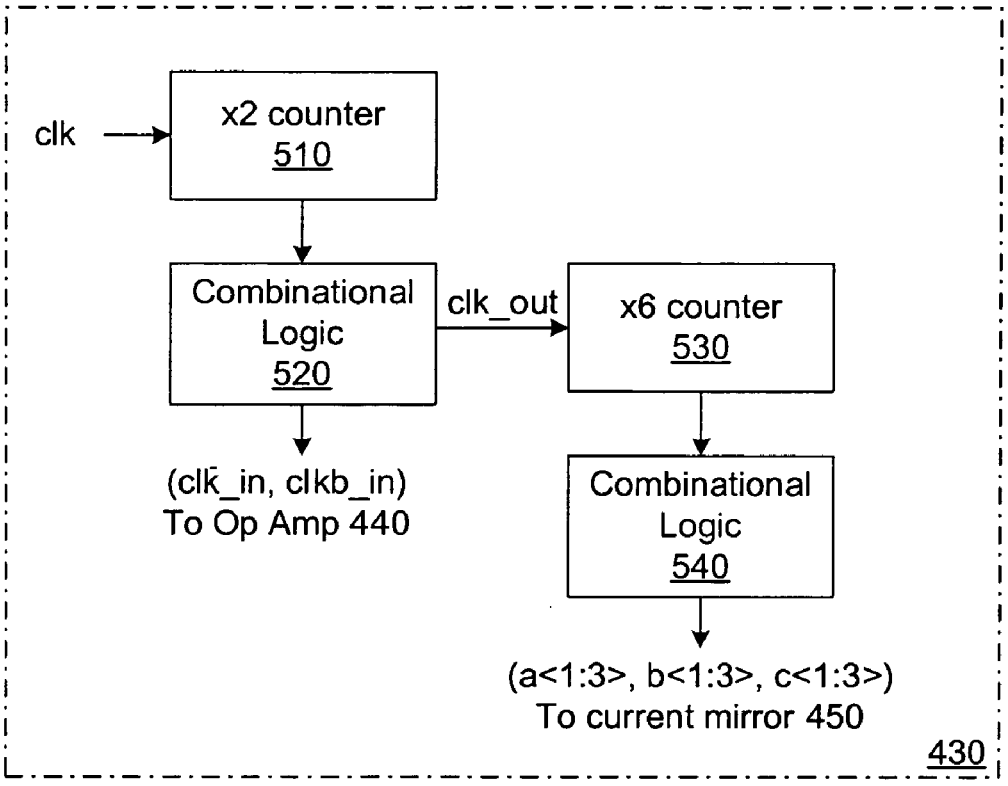
FIG. 5 is a block diagram illustrating one embodiment of the digital control block included within the Bandgap circuit of FIG. 4.

Digital control block 430 is coupled to oscillator 420 for receiving the internal clocking signal ("clk") and for generating a plurality of control signals in response thereto. According to one embodiment, digital control block 430 may include a "divide-by-2" (x2) counter 510, a "divide-by-6" (x6) counter 530 and some combinational logic 520, 540 to generate a plurality of control signals, as shown in FIG. 5. For example, x2 counter 510 may be coupled for receiving the internal clocking signal ("clk") from oscillator 420 (or from another internal clock). In response to the clocking signal, the x2 counter 510 and combinational logic 520 may be used for generating a first subset of control signals (e.g., "clk_in", "clkb_in"), which may be supplied to operational amplifier 440 for reducing mismatch-induced voltage offsets attributed to the operational amplifier. In some cases, at least one of the control signals (e.g., "clk_in") may be supplied to x6 counter 530 and combinational logic 540 for generating a second subset of control signals (e.g., a<1:3>, b<1:3>, c<1:3>). As described in more detail below, the second subset of control signals may be supplied to current mirror circuit 450 for reducing mismatch-induced current offsets attributed to the current mirror circuit.

According to one embodiment, POR circuit 410, oscillator 420 and digital control block 430 may each be implemented with high voltage (HV) devices. As used herein, a "high voltage device" may be described as any device (e.g., a transistor or other circuit element) capable of withstanding a "high voltage" between any two terminals without suffering damage. "High voltage devices" are typically formed with thicker gate oxides and longer channel lengths. In one example, a "high voltage device" may be described as having a gate oxide thickness ($t_{ox}$) of about 50 to about 500 Å or more. It should be noted, however, that the term "high voltage" is relative and dependent on technology. In some cases, blocks 410, 420 and 430 may be implemented with HV devices to avoid power supply feedback problems. For example, power supply feedback problems may be avoided by ensuring that all logic control signals are HVCMOS with signal swings between 0 and VCC (i.e., all logic is supplied directly off VCC). Although blocks 410, 420 and 430 could be implemented with low voltage (LV) devices, in other cases, the use of low voltage devices would increase the complexity of the blocks, as well as the amount of area and current consumed by the blocks. Therefore, POR circuit 410, oscillator 420 and digital control block 430 are implemented with HV devices in preferred embodiments of the invention.

As shown in FIG. 4, the analog part of BGR circuit 400 may include operational amplifier 440, current mirror circuit 450, bipolar array 460, resistor farm 470, low pass filter 480 and start-up circuit 490. The generation of a stable reference voltage and specific implementations of operational amplifier 440, current mirror circuit 450, bipolar array 460 and resistor farm 470 will be described below in reference to FIGS. 5-9.

The purpose of start-up circuit 490 is to ensure that BGR circuit 400 is in the correct operating state. In other words, BGR circuit 400 may have two stable operating points: power-down (e.g., 0 V) and power-on (e.g., VCC). To ensure that BGR 400 is in the correct operating state, start-up circuit 490 detects whether or not BGR 400 is currently operating in the wrong state. If the wrong operating state is detected, start-up circuit 490 supplies a "start" signal to operational amplifier 440, which forces BGR 400 to the desired "power-on" stable operating point. Substantially any start-up circuit known in the art may be used to generate the "start" signal supplied to operational amplifier 440.

Once a reference voltage is generated by BGR circuit 400, low pass filter 480 may be used to remove any high frequency mismatch-induced noise components remaining in the Bandgap output signal ("vbg_out"). According to one embodiment, low pass filter 480 may be implemented as a passive 4-cell RC ladder having a minimum cut-off frequency of about 43 KHz and a minimum attenuation of about 20 dB at the specified clock frequency. Though such a filter may be used for successfully attenuating mismatch-induced noise components around 833 KHz, alternative low pass filter designs/characteristics may be implemented as desired (e.g., when the internal clocking signal frequency differs from 10 MHz or when a greater or lesser amount of attenuation is desired).

Unlike the digital blocks discussed above, analog blocks 440, 450, 460, 470, 480 and 490 may be implemented primarily with small, low voltage (LV) devices to reduce layout area and enable low power Bandgap operation. As used herein, a "low voltage device" may be described as any device (e.g., a transistor or other circuit element) having a gate oxide thickness ($t_{ox}$) of about 10 to 20 Å, depending on technology. In addition, a "small" low voltage device may be described as a transistor (or other circuit element) having a gate area (i.e., length times width) of less than 5 times the minimum dimension allowed by a certain technology. In one example, a "small" low voltage device may have a gate area of about 1 $\mu m^2$ to 5 $\mu m^2$.

However, a problem arises when small, low voltage devices are used within the analog blocks of BGR circuit 400.

In particular, the small, low voltage devices tend to produce relatively large voltage and current offsets (caused, e.g., when variations in process, voltage and/or temperature lead to transistor mismatch) within the operational amplifier and current mirror portions of the BGR circuit. Therefore, various solutions are provided below for reducing such offsets and improving the accuracy of the low power Bandgap circuit described herein.

As noted above, digital control block 430 may be configured for generating a first subset of control signals ("clk_in"/"clkb_in") in response to the internal clocking signal supplied thereto. In some cases, the control signals may be supplied to operational amplifier 440 for reducing mismatch-induced voltage offsets by modulating the input signals supplied to the first stage of the operational amplifier and demodulating the output of the first stage of the operational amplifier with a reduced duty cycle clocking signal. For example, the "clk_in" and "clkb_in" control signals may each be supplied to operational amplifier 440 with a duty cycle, which is about 50% that of the internal clocking signal (e.g., 50% of 10 MHz=5 MHz) supplied to digital control block 430. If any voltage offsets occur within the output of the operational amplifier, the "clk_in" and "clkb_in" control signals (along with chopped stabilization input circuits 710, 720 of FIG. 7) enable a positive voltage offset to be generated during one half of each clock period (i.e., a first phase), and an equally negative voltage offset to be generated during another half of each clock period (i.e., a second phase) of the internal clocking signal ("clk"). As described in more detail below, the first subset of control signals may be used for reducing the voltage offsets attributed to the operational amplifier by averaging out the positive and negative offset components generated during each full clock phase of the internal clocking signal.

Figure 6:
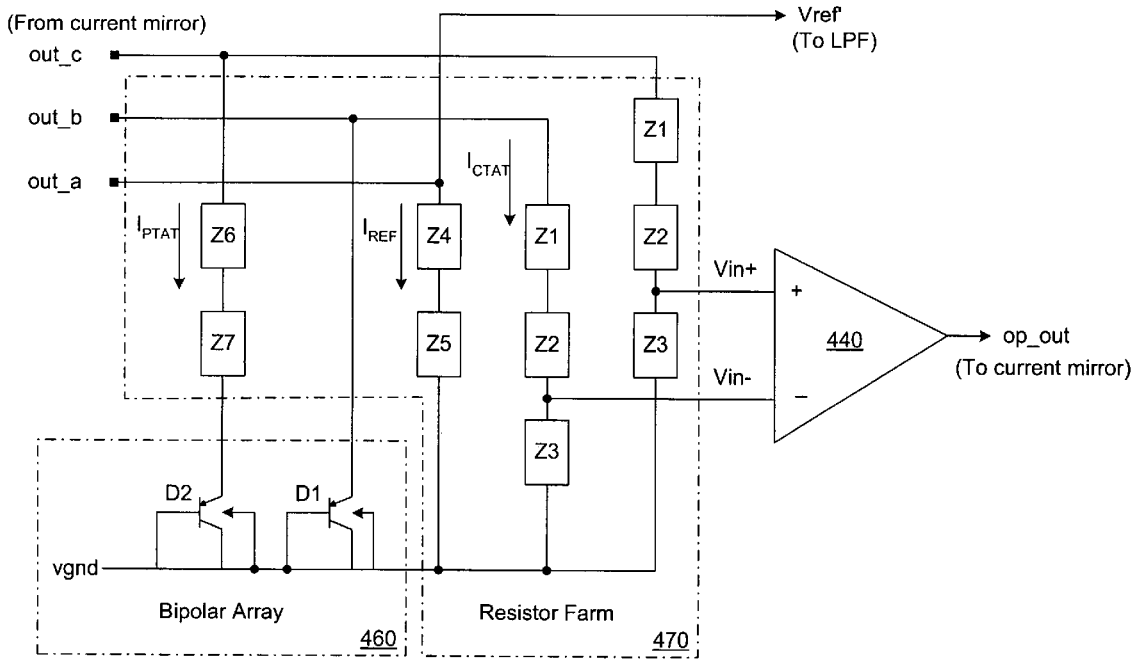
FIG. 6 is a block diagram illustrating on embodiment of the bipolar array, resistor farm and operational amplifier included within the Bandgap circuit of FIG. 4.

An exemplary circuit and method for reducing mismatch-induced voltage offsets will now be described in reference to FIGS. 4-7. As shown in FIGS. 4 and 6, a vertical PNP bipolar array 460 may be used to derive the PTAT and CTAT currents for the Bandgap circuit. For example, the CTAT current may be generated by developing a base-emitter voltage ($V_{BE}$) of a bipolar junction transistor (BJT) across a resistor when the BJT is biased in normal active mode. As used herein, a "normal active mode of operation" for a BJT refers to the case when the base-emitter junction of the BJT is forward biased and the base collector junction of the BJT is reverse biased. In FIG. 6, the CTAT current is generated by developing a base-emitter voltage ($Vbe_1$) of transistor D1 across impedance blocks Z1, Z2 and Z3. In other words, the CTAT current, $I_{CTAT}$, can be expressed as:

$$I_{CTAT}=Vbe_1/(Z1+Z2+Z3) \quad \text{EQ. (6)}$$

In a similar manner, the PTAT current may be generated by developing another voltage across impedance blocks Z6 and Z7. For example, the voltage across impedance blocks Z6 and Z7 may be generated as the difference between the base-emitter voltages of two bipolar junction transistors (BJT) biased in normal active mode of operation, with the two respective base-emitter junctions having different current densities. In FIG. 6, the voltage developed across impedance blocks Z6 and Z7 represents a difference between the base-emitter voltages of transistors D1 and D2. In such an embodiment, the PTAT current, $I_{PTAT}$, can be expressed as:

$$I_{PTAT}=(Vbe_1-Vbe_2)/(Z6+Z7) \quad \text{EQ. (7)}$$

In some cases, the current density of transistor D1 may be N times larger than the current density of transistor D2. This may be accomplished by replicating the first transistor (D1) a number of times (e.g., N=48) to generate the second transistor (D2) with N times larger area. Therefore, the PTAT current may be alternatively expressed as:

$$I_{PTAT}=(kT/q)*\ln(N)*(1/(Z6+Z7)) \quad \text{EQ. (8)}$$

As shown in FIGS. 4 and 6, the PTAT and CTAT currents may be modulated by resistor farm 470 to provide the $\beta_1$ and $\beta_2$ coefficients of equation (3). As shown in FIG. 6, for example, resistor farm 470 may include a first plurality of resistors (e.g., impedance blocks Z1, Z2 and Z3) for generating a voltage (Vin−) related to the CTAT current, and a second plurality of resistors (e.g., impedance blocks Z6 and Z7) for generating a voltage (Vin+) related to the PTAT current. A third plurality of resistors (e.g., impedance blocks Z4 and Z5) may also be included within resistor farm 470 for generating the reference voltage (Vref'). For example, a reference current, $I_{REF}$, may be generated by combining the CTAT and PTAT currents, such that:

$$I_{REF}=\beta_1*Vbe_1/(Z1+Z2+Z3)+\beta_2(kT/q)(\ln(N))*(1/(Z6+Z7)) \quad \text{EQ. (9)}$$

The reference voltage (Vref') may then be generated by passing the reference current through impedance blocks Z4 and Z5, such that:

$$Vref'=(Z4+Z5)*I_{REF}. \quad \text{EQ. (10)}$$

As shown in FIG. 4, the reference voltage may then be output from Bandgap circuit 400 after passing through current mirror circuit 450 and low pass filter 480.

In one embodiment, impedance blocks Z1-Z7 may be configured such that: Z1=12R, Z2=48R, Z3=112R, Z4=80R, Z5=7R, Z6=6R, Z7=36R when R=816.3265 Ω. It is noted, however, that alternative resistance values and/or alternative groupings of impedance blocks may be appropriate in other embodiments of the invention.

Next, the Vin− and Vin+ voltages generated by resistor farm 470 may be supplied to the positive and negative input terminals of operational amplifier 440, where they are amplified and compared against one another for generating a difference signal (op_out). In some cases, the accuracy of the amplified difference signal (otherwise referred to as the output of the operational amplifier) may be adversely affected by offsets in the input voltages supplied to the op amp. In particular, variations in process, voltage and/or temperature may produce mismatch-induced voltage offsets within the matched transistors of the op amp circuit. These offsets are inversely proportional to area, and therefore, tend to increase when using small, low voltage devices (such as those used in the analog blocks of Bandgap circuit 400). To compensate for such offsets, the present invention may include a pair of chopped stabilization circuits 710, 720 at the input of operational amplifier 440, as shown in FIG. 7.

Figure 7:
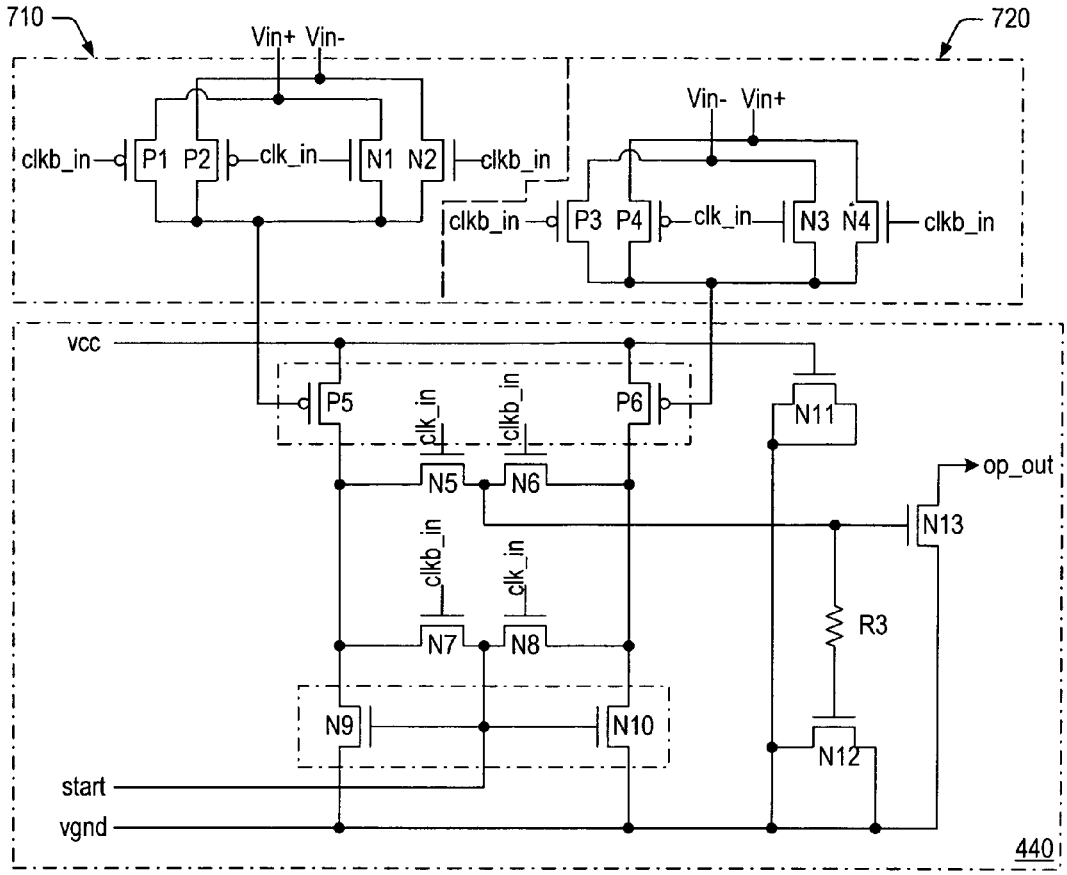
FIG. 7 is a circuit diagram illustrating on embodiment of the operational amplifier included within the Bandgap circuit of FIG. 4.

FIG. 7 illustrates one embodiment of an operational amplifier 440 including a pair of chopped stabilization input circuits 710, 720. In some cases, op amp 440 may be referred to as a 2-stage OTA with lead-lag (or shunt) compensation. In other words, op amp 440 utilizes a compensation technique to ensure stable (i.e., "oscillation free") operation of the op amp. In the embodiment of FIG. 7, compensation is provided by resistor R3 and the capacitor formed by transistor N12. It is noted, however, that the chopped stabilization technique described herein may be applied to substantially any other op amp design deemed appropriate.

In the embodiment of FIG. 7, chopped stabilization input circuits 710 and 720 each include a pair of complementary CMOS switches (P1/N1, P2/N2 and P3/N3, P4/N4) for receiving the positive and negative input voltages (Vin− and Vin+) generated by resistor farm 470. As noted above, the input voltages may be chopped with a pair of 50% duty cycle clocking signals ("clk_in" and "clkb_in") to generate an output voltage (op_out) having a positive voltage offset during one half of each clock period (i.e., a first clock phase) and a negative voltage offset during another half of each clock period (i.e., a second clock phase) of the internal clocking signal ("clk").

For example, Vin+may be supplied to the gate terminal of transistor P5, while Vin− is supplied to the gate terminal of transistor P6 during a first phase of the internal clocking signal (e.g., when the "clk_in" signal is high and "clkb_in" signal is low). During a second phase, the opposite input voltage may be supplied to the gate terminals of the matched transistors. For example, when the "clk_in" signal is low and "clkb_in" signal is high, Vin− may be supplied to transistor P5 while Vin+ is supplied to transistor P6. By supplying the positive and negative input voltages to the gate terminals of transistors P5/P6 in an alternate manner (via control signals "clk_in" and "clkb_in"), chopped stabilization input circuits 710 and 720 ensure that the currents flowing through the legs of the op amp (P5/N9 and P6/N10) are swapped during each full period of the internal clocking signal. If transistors P5/P6 or transistors N9/N10 are not perfectly matched, the chopped stabilization technique enables a positive voltage offset to be generated during one half of each clock period, and an equally negative voltage offset to be generated during another half of each clock period of the internal clocking signal. In other words, the chopped stabilization technique reduces and/or eliminates mismatch-induced voltage offsets attributed to the operational amplifier by averaging out the positive and negative voltage offsets generated during each full period of the internal clocking signal.

The remaining transistors (N5, N6, N7, N8, N11, N12, N13) shown in FIG. 7 operate as follows: transistors N5, N6, N7, N8 switch the output to the input in a synchronous manner to preserve signal phase; transistors N11 and N12 are used as filter and compensation capacitors, respectively; and transistors N13 is the output stage of the operational amplifier.

In some embodiments, chopped stabilization input circuits 710 and 720 may be implemented with high-voltage CMOS complementary switches (P1/N1, P2/N2 and P3/N3, P4/N4) to reduce gate leakage, increase accuracy and to avoid transistor breakdown (which may result when supplying high voltage clocking signals to low voltage transistors). In some embodiments, operational amplifier 440 may be implemented with low voltage devices (P5, P6, N9 and N10) in the first stage of the amplifier and with high voltage devices (N5-N8, N11 and N12) in the second stage of the amplifier. Along with the low voltage device (N13) used in the output stage, transistors P5, P6, N9 and N10 ensure that only low voltage devices are used in the signal path of the op amp circuit. This enables op amp 440 to operate under low power supply conditions. In such embodiments, op amp circuit 440 may provide a gain between about 40-50 dB over an operating bandwidth of approximately 3-10 MHz (depending on PVT corners). In some cases, the use of small high voltage switches (N5-N8) may be combined with the chopped stabilization technique to provide a power supply rejection (PSR) ratio in excess of 32 dB.

In addition to voltage offsets, digital control block 430 may be configured for generating a second subset of control signals (a<1:3>, b<1:3>, c<1:3>), which are supplied to current mirror circuit 450 for reducing mismatch-induced current offsets attributed to the current mirror circuit. As noted above, for example, one of the first subset of control signals (e.g., "clk_in") may be supplied to x6 counter 530 and combinational logic 540 of the digital control block for generating a second subset of control signals (e.g., a<1:3>, b<1:3>, c<1:3>), corresponding to six distinct phases of the "clk_in" signal. As described in more detail below, the second set of control signals may be used for reducing mismatch-induced current offsets by dynamically matching the current mirror outputs during each phase of the clocking signals a<1:3>, b<1:3>, c<1:3>.

Figure 8:
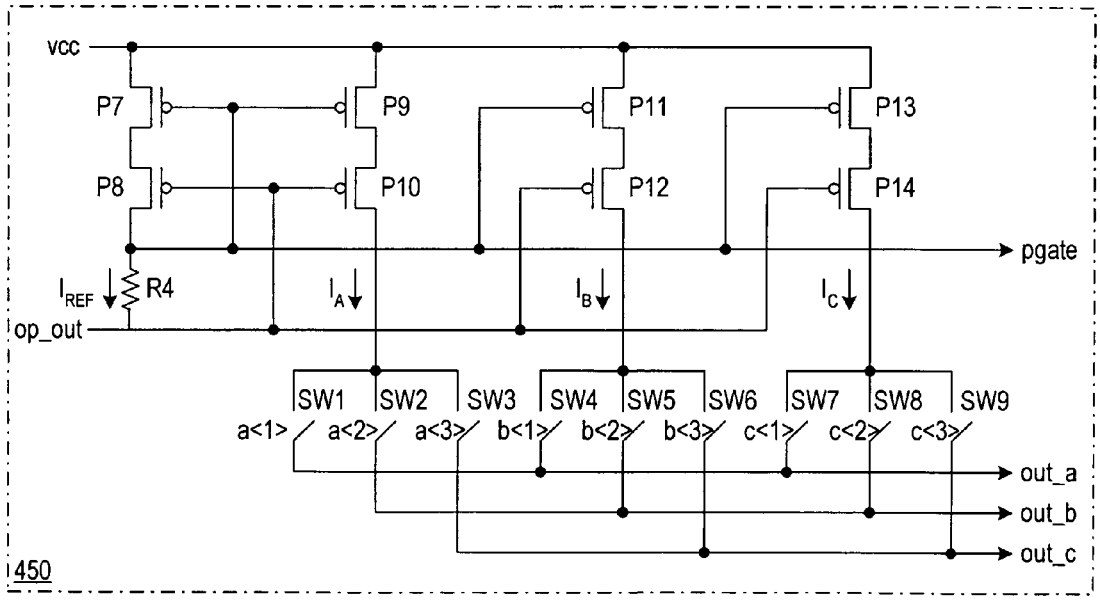
FIG. 8 is a circuit diagram illustrating one embodiment of the three-branch current mirror circuit included within the Bandgap circuit of FIG. 4.

An exemplary circuit and method for reducing mismatch-induced current offsets will now be described in reference to FIGS. 8-9. As shown in FIG. 8, a plurality of cascoded devices (P7-P14) may be combined to form a three-branch current mirror circuit 450. As used herein, the term "cascoded devices" may be used to describe two or more transistors, whose source-drain paths are coupled in series. More specifically, a "cascoded device" may be described as a combination of a "common source" connected device and a "common gate" connected device. In some cases, the use of cascoded devices may help to reduce mismatch-induced current offsets within the current mirror circuit, especially when the cascoded devices are implemented with small, low voltage devices to reduce layout area and enable low power Bandgap operation.

In the embodiment of FIG. 8, small low voltage PMOS devices P7-P14 are used to form the cascoded devices of current mirror circuit 450. More specifically, four pairs of PMOS devices (P7/P8, P9/P10, P11/P12 and P13/P14) are coupled in series between a power supply node (VCC) and the output (op_out) of operational amplifier 440. The gate terminals of transistors P8, P10, P12 and P14 are coupled for receiving the output (op_out) of operational amplifier 440. The gate terminals of transistors P7, P9, P11 and P13 are coupled between the drain terminal of transistor P8 and resistor R4 for supplying a pass gate ("pgate") signal to start-up circuit 490. The pass gate signal is a measure of the voltage generated across resistor R4.

During operation, the reference current (Iref) generated through input transistors P7/P8 and resistor R4 is mirrored to transistors P9/P10, P11/P12 and P13/P14 by coupling the gate terminals of transistors P7/P9 and P8/P10 together. In other words, the mirrored currents ($I_A$, $I_B$ and $I_C$) generated through transistors P9/P10, P11/P12 and P13/P14 should be identical to the reference current (Iref) generated through input transistors P7/P8 and resistor R4 when transistors P7-P14 are perfectly matched. In an ideal situation, two of the mirrored currents (e.g., $I_C$ and $I_B$) could be supplied to the operational amplifier for generating the difference signal, while a third mirror current (e.g., $I_A$) is supplied to resistor farm 470 for generating the reference voltage (Vref).

However, mismatches between the cascoded devices may generate current offsets in the current mirror circuit by causing one or more of the mirrored currents (e.g., $I_A$, $I_B$ and/or $I_C$) to differ from the reference current (Iref). For this reason, a plurality of dynamically controlled switches (SW1-SW9) may be included in preferred embodiments of the invention to increase the accuracy of the Bandgap circuit. As described in more detail below, Bandgap accuracy may be improved by dynamically matching the current mirror outputs to compensate for any current offsets that may (or may not) occur within the current mirror circuit.

As shown in FIG. 8, current mirror circuit 450 may include three output nodes (out_a, out_b and out_c) for supplying the mirrored currents to downstream circuit components (e.g., op amp 440 and resistor farm 470). To compensate for mismatch-induced current offsets, a plurality of switches (SW1-SW9) are coupled in sets of three between each branch of the current mirror and the three output nodes. In the embodiment of FIG. 8, three parallel-coupled switches are included within each set of switches, and each set of switches is coupled for receiving a different one of the mirrored currents (e.g., switches SW1, SW2, SW3 are coupled for receiving mirrored current $I_A$, switches SW4, SW5, SW6 are coupled for receiving mirrored current $I_B$, etc.).

The plurality of switches (SW1-SW9) are controlled by the second subset of control signals (e.g., a<1:3>, b<1:3>, c<1:3>) generated by digital control block 430. As noted above, for example, x6 counter 530 and combinational logic 540 generate the second subset of control signals by dividing the reduced duty cycle clocking signal (e.g., the "clk_in" signal) into six distinct clock phases. According to one embodiment, a "clk_in" signal of about 5 MHz may be divided into six distinct clock phases to modulate the lowest current mismatch-induced noise component around 833 KHz. It is noted, however, that the modulation frequency is somewhat arbitrary and depends on technology, noise rejection requirements, etc.

The second subset of control signals are used to control the plurality of switches, such that only one switch within each set of switches is activated for conducting current during each distinct clock phase. As shown in FIG. 9, for example, control signals a<1>, b<2> and c<3> may be supplied to the three sets of switches for activating switches SW1, SW5 and SW9 during phase 1 of the six-phase clocking signal. During phase 2, control signals a<1>, b<3> and c<2> may be supplied for activating switches SW1, SW6 and SW8. During phase 3, control signals a<2>, b<3> and c<1> may be supplied for activating switches SW2, SW6 and SW7. During phase 4, control signals a<3>, b<2> and c<1> may be supplied for activating switches SW3, SW5 and SW7. During phase 5, control signals a<3>, b<1> and c<2> may be supplied for activating switches SW3, SW4 and SW8. During phase 6, control signals a<2>, b<1> and c<3> may be supplied for activating switches SW2, SW4 and SW9.

The control sequence shown in FIG. 9 may be used in some embodiments of the invention to reduce switching noise by deactivating a currently active switch and activating a different switch within only two of the three sets of switches during any two consecutive clock phases. However, the switching scheme shown in FIG. 9 is only one example of a preferred switching scheme. Other schemes may be used in other embodiments of the invention.

Regardless of the particular switching scheme used, the second subset of control signals can be used for reducing mismatch-induced current offsets attributed to the current mirror circuit by averaging the mirrored currents to cancel out any mismatch-induced current offsets existing between the low-voltage cascoded devices. In one embodiment, output nodes out_a, out_b and out_c may each be configured for receiving equal amounts of mirrored currents ($I_A$, $I_B$ and $I_C$) over the duration of the six-phase clocking signal. For example, output nodes out_a, out_b and out_c may each be equal to $(I_A+I_B+I_C)/3$ over the duration of the six-phase clocking signal. In other words, the dynamic current matching technique described herein can be used to reduce mismatch-induced current offsets attributed to the current mirror circuit by providing substantially identical output currents, even when the cascoded devices are not perfectly matched.

In some embodiments, the plurality of switches (SW1-SW9) may be implemented with high voltage PMOS devices to avoid power supply feedback problems and to increase the accuracy of the Bandgap circuit. When combined with the small, low voltage cascoded devices used in the current mirror portion, the plurality of switches create a highly accurate, unity-ratioed triple current mirror circuit 450 with much less sensitivity to variations in process, voltage and temperature.

In some embodiments, the dynamic current matching technique described in FIGS. 8-9 can be used without the chopped stabilization technique described in FIGS. 5-7 to increase Bandgap accuracy by reducing and/or eliminating mismatch-induced current offsets attributed to the current mirror circuit. However, the dynamic current matching and chopped stabilization techniques may be combined in preferred embodiments of the invention to provide maximum Bandgap accuracy (e.g., by reducing voltage and current offsets) when using primarily small, low voltage (i.e., leaky) transistors in the analog blocks of the Bandgap circuit to reduce layout area and power consumption.

FIG. 10 is a table comparing exemplary simulation results for the Bandgap circuit shown in FIGS. 4-9 (i.e., the "new design") and a simple current adding configuration (i.e., the "old design") that uses exclusively large area HV devices without implementing the dynamic current matching or input chopper stabilization techniques described herein. In both cases, low voltage power supply (e.g., about 1.6 volts to about 2.0 volts) and extended temperature range (e.g., about −40° C. to about 140° C.) are assumed. Under these conditions, the "new" and "old" designs are both capable of delivering a nominal reference voltage output of approximately 600 mV.

As shown in FIG. 10, the "new" Bandgap circuit shown in FIGS. 4-9 improves upon the "old" design in all aspects except for current consumption (ICC), which should be irrelevant in a technology expected to leak in the tens of milliamps range. The improvement is substantial for some parameters like layout area (approx. 500%), start-up time (approx. 470%), settling time (approx. 290%), Monte Carlo (MC) accuracy (approx. 160%) and percentage overshoot (approx. 1000%). The only area that does not improve (current consumption) is due to the added current needs of the additional digital blocks (e.g., the local oscillator, digital block, etc.).

As noted above, the chopped stabilization and dynamic current matching techniques described herein enable small, low voltage devices to be used within the analog blocks of the "new" Bandgap circuit without sacrificing accuracy. In addition to significantly reducing layout area (as shown in FIG. 10), the use of small, low voltage devices provide the added advantage of reducing the minimum power supply voltage limit (e.g., from about 1.6 volts to about 1.4 volts, or lower, depending on technology).

It will be appreciated to those skilled in the art having the benefit of this disclosure that this invention is believed to provide a low power Bandgap circuit with improved accuracy and reduced area consumption. Further modifications and alternative embodiments of various aspects of the invention will be apparent to those skilled in the art in view of this description. It is intended that the following claims be interpreted to embrace all such modifications and changes and, accordingly, the specification and drawings are to be regarded in an illustrative rather than a restrictive sense.

What is claimed is:

1. A Bandgap reference (BGR) circuit configured for reducing mismatch-induced voltage and current offsets within the BGR circuit, the BGR circuit comprising:

an operational amplifier having a pair of chopped stabilization input circuits for reducing a voltage offset attributed to the operational amplifier;

three current mirror devices coupled for receiving an output of the operational amplifier and configured for generating three substantially identical currents therefrom;

three sets of dynamically controlled switches, wherein each set of switches is coupled for receiving a different one of the three substantially identical currents; and digital control logic configured for reducing a current offset attributed to the current mirror devices by controlling the three sets of switches, so that:

only one switch in each set of switches is activated for conducting current during a first phase of a multi-phase clocking signal; and only one of the switches activated during the first phase remains activated during each consecutive phase of the multi-phase clocking signal.

2. The Bandgap reference circuit as recited in claim 1, wherein the three current mirror devices comprise three pairs of low-voltage cascoded devices.

3. The Bandgap reference circuit as recited in claim 1, wherein the three sets of dynamically controlled switches comprises three sets of three parallel-coupled switches.

4. The Bandgap reference circuit as recited in claim 1, wherein the digital control logic is coupled for receiving a clocking signal and configured for generating a plurality of control signals in response thereto.

5. The Bandgap reference circuit as recited in claim 4, wherein the digital control logic is configured for generating a first subset of the control signals by dividing the clocking signal in half to generate two equal-length phases of a second clocking signal, which is supplied to the operational amplifier and to the pair of chopped stabilization input circuits for modulating the output of the operational amplifier.

6. The Bandgap reference circuit as recited in claim 5, wherein if mismatched-induced voltage offsets occur within the output of the operational amplifier, the first subset of control signals enables a positive voltage offset to be generated during one clock phase and an equally negative voltage offset to be generated during a next clock phase of the second clocking signal.

7. The Bandgap reference circuit as recited in claim 6 wherein the digital control logic, the operational amplifier and the pair of chopped stabilization input circuits are configured for reducing mismatch-induced voltage offsets attributed to the operational amplifier by averaging out the positive and negative voltage offsets generated over two consecutive clock phases of the second clocking signal.

8. The Bandgap reference circuit as recited in claim 5, wherein the digital control logic is configured for using one of the first subset of control signals to generate a second subset of control signals by dividing one phase of the second clocking signal by six to generate six equal-length phases of a third clocking signal, which is supplied to the three sets of dynamically controlled switches as the multi-phase clocking signal.

9. The Bandgap reference circuit as recited in claim 8, wherein the digital control logic and the three sets of dynamically controlled switches are configured to eliminate any mismatch-induced current offsets existing between the three current mirror devices by averaging the three substantially identical currents during each phase of the third clocking signal.

10. The Bandgap reference circuit as recited in claim 1, wherein the three sets of dynamically controlled switches are implemented with high voltage devices to increase the accuracy of the BGR circuit.

11. The Bandgap reference circuit as recited in claim 1, wherein all transistors within the BGR circuit, except for the three sets of dynamically controlled switches, are implemented with low voltage devices to enable the BGR circuit to remain operational under power supply conditions of about 1.6 volts and below.

12. A current adding Bandgap reference (BGR) circuit configured for generating a stable reference voltage across a specified range of process, voltage and temperature values, the BGR circuit comprising:

a plurality of diodes coupled for producing a proportional to absolute temperature (PTAT) current and a complementary to absolute temperature (CTAT) current;

an operational amplifier coupled for receiving the PTAT and CTAT currents and configured for generating a difference signal therefrom;

three current mirror devices coupled for receiving the difference signal and configured for generating three substantially identical currents therefrom;

three sets of switches, wherein each set of switches is coupled for receiving a different one of the three substantially identical currents;

digital control logic configured for averaging the three substantially identical currents over consecutive phases of a multi-phase clocking signal by controlling the three sets of switches, so that;

only one switch in each set of switches is activated for conducting current during a first phase of the multi-phase clocking signal; and only one of the switches activated during the first phase remains activated during a consecutive phase of the multi-phase clocking signal; and at least one resistor coupled to the three sets of switches for receiving the averaged current and configured for developing the stable reference voltage thereacross.

13. The current adding BGR circuit as recited in claim 12, wherein the three current mirror devices comprise three pairs of low-voltage cascoded devices, and wherein the three sets of switches comprise three sets of three parallel-coupled switches.

14. The current adding BGR circuit as recited in claim 12, wherein the digital control logic is configured for receiving a first clocking signal and for generating:

a first subset of the control signals, which are supplied to the operational amplifier for reducing mismatch-induced voltage offsets attributed to the operational amplifier by modulating the difference signal with a second clocking signal, whose duty cycle is about 50% that of the first clocking signal; and a second subset of the control signals generated by dividing one phase of the second clocking signal into six distinct phases of a third clocking signal, wherein the second subset of the control signals is supplied to the three sets of switches for reducing mismatch-induced current offsets attributed to the current mirror devices by controlling the activation of switches, such that only one switch in each set of switches is activated for conducting current during each distinct clock phase of the third clock signal.

15. The current adding BGR circuit as recited in claim 14, wherein the operational amplifier comprises a pair of chopped stabilization input circuits for receiving the first subset of control signals, and in response thereto, generating a positive voltage offset and an equally negative voltage offset during two consecutive phases of the second clocking signal.

* * * * *